United States Patent [19]

Sabrowsky et al.

[11] 4,127,949

[45] Dec. 5, 1978

[54] SNOWMOBILE TRAIL GROOMER

[75] Inventors: Gerald Sabrowsky; Chancy M. Walker, both of Manawa, Wis.

[73] Assignee: S & W Sales, Inc., Manawa, Wis.

[21] Appl. No.: 832,106

[22] Filed: Sep. 9, 1977

[51] Int. Cl.[2] ..... E01C 19/00

[52] U.S. Cl. ..... 37/13; 172/188; 172/197; 172/199

[58] Field of Search ..... 37/10, 1, 41; 172/140, 172/160, 188, 197, 198, 199, 200

[56] References Cited

U.S. PATENT DOCUMENTS

| | | | |
|---|---|---|---|
| 1,364,007 | 12/1920 | Thompson | 172/188 X |
| 1,797,476 | 3/1931 | McCain et al. | 172/140 |
| 3,006,422 | 10/1961 | Mighell | 172/142 |
| 3,225,839 | 12/1965 | Petitt | 172/398 |
| 3,554,295 | 1/1971 | Kopasua | 172/398 X |
| 3,815,688 | 6/1974 | Brown | 172/789 |
| 3,878,900 | 4/1975 | Boisse et al. | 172/145 |
| 3,915,239 | 10/1975 | Hendrichon | 172/197 X |
| 4,002,413 | 1/1977 | Foster | 172/199 X |
| 4,014,116 | 3/1977 | Baechler | 172/188 |
| 4,057,916 | 11/1977 | Roemer | 37/43 R |

*Primary Examiner*—E. H. Eickholt

*Attorney, Agent, or Firm*—Clarence A. O'Brien; Harvey B. Jacobson

[57] ABSTRACT

An elongated main frame is provided including front and rear end portions. An elongated dual track endless track drive assembly is oscillatably supported from the rear end portion of the frame for angular displacement about a first horizontal transverse axis intermediate the opposite ends of the track drive assembly. A front dirigible ski equipped support assembly is carried by the front end portion of the frame forward of the drive assembly and an elongated longitudinally extending sub-frame including front and rear end portions is supported from the main frame front end portion for angular displacement about a second horizontal axis extending transversely of the main frame and the front end portion of the sub-frame. The rear end portion of the sub-frame includes transversely spaced depending packed and icy snow cover working times and an upstanding transverse blade member rearward of the tines including a generally horizontal lower edge portion. Lift structure is operatively connected between the sub-frame and the main frame for selective angular displacement of the sub-frame about the second axis to raise and lower the rear end portion of the sub-frame, and thus the tines and blade member, relative to snow cover over which the main frame is being forwardly advanced by the drive assembly.

6 Claims, 5 Drawing Figures

SNOWMOBILE TRAIL GROOMER

BACKGROUND OF THE INVENTION

The trail groomer of the instant invention has been developed to provide a means to renew snowmobile trails. Snow mobile trails, after reasonably long periods of use, tend to become wavy and to develop ruts. A snowmobile trail which is wavy and includes ruts presents a safety hazard and can cause snowmobiles to uncontrolably leave the snowmobile trail or to be upset. Accordingly, some means must be provided to renew snowmobile trails to have smooth surfaces.

Various forms of drags and other equipment have been heretofore designed for the purpose of grooming snowmobile trails. In addition, other forms of equipment including some of the general structural and operational features of the instant invention have also been heretofore provided.

Examples of various structures provided for renewing snowmobile trails and including some of the general structural and operational features of the instant invention are disclosed in U.S. Pat. Nos. 2,786,283, 2,986,828, 3,351,535, 3,576,214, 3,685,404, 3,724,557, 3,739,859, and 3,795,069.

BRIEF DESCRIPTION OF THE INVENTION

The snowmobile trail groomer of the instant invention includes an elongated main frame from whose rear end portion a dual track endless track drive assembly is oscillatably supported for angular displacement about a first horizontal transverse axis and the front end of the main frame includes depending dirigible ski structure. An elongated sub-frame is disposed beneath the forward end of the main frame and has its forward end oscillatably supported from the forward main frame for angular displacement about a horizontal transverse axis. The rear end portion of the sub-frame includes depending transversely spaced packed and icy snow cover working tines and an upstanding transverse blade member rearward of the tines including a generally horizontal lower edge portion. Structure is connected between the rear end of the sub-frame and the main frame establishing an adjustable lower limit of movement of the rear end of the sub-frame relative to the main frame.

The main object of this invention is to provide an apparatus which will be capable of breaking up a wavy and rutted snowmobile trail including packed and icy snow and smoothing out the trail.

Another object of this invention is to provide a snowmobile trail groomer in accordance with the preceding object and including a drive assembly therefor which will provide the trail groomer with sufficient traction on packed and icy snow to enable the depending tines of the grooves to be forced through packed and icy snow and to be broken up and leveled as the trail groomer is moved forwardly along a snowmobile trail.

Yet another object of this invention is to provide an apparatus in accordance with the preceding objects and which may be readily operated by a single person.

Still another object of this invention is to provide a snowmobile trail groomer constructed in accordance with the preceding objects and which may be readily trucked to remote snowmobile trail locations.

A final object of this invention to be specifically enumerated herein is to provide a snowmobile trail groomer in accordance with the preceding objects and which conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
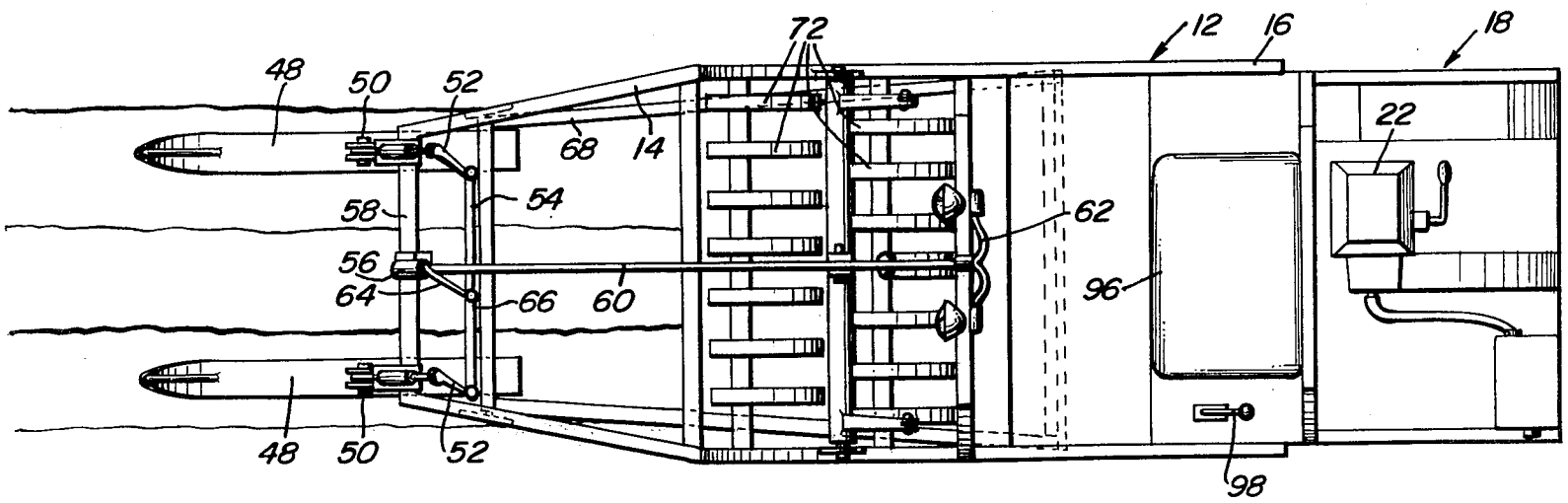
FIG. 1 is a top plan view of the snowmobile trail groomer of the instant invention.
Figure 5:
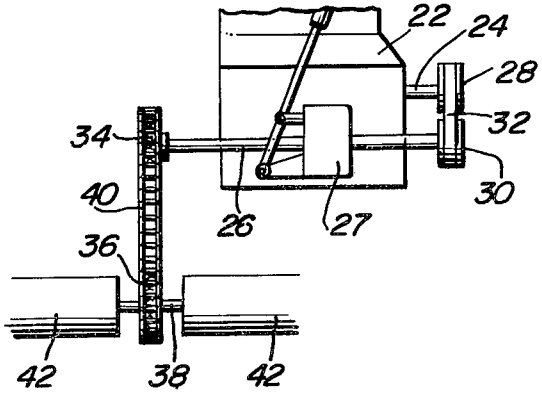
FIG. 5 is a fragmentary, schematic view of the drive assembly of the snowmobile trail groomer.
Figure 3:
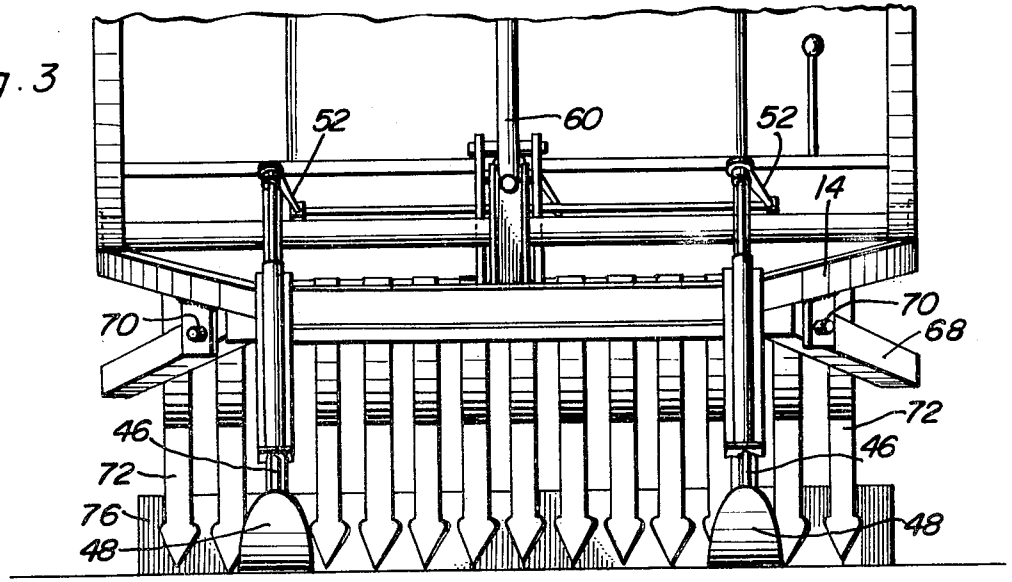
FIG. 3 is a fragmentary, enlarged, front elevational view of the snowmobile trail groomer.
Figure 2:
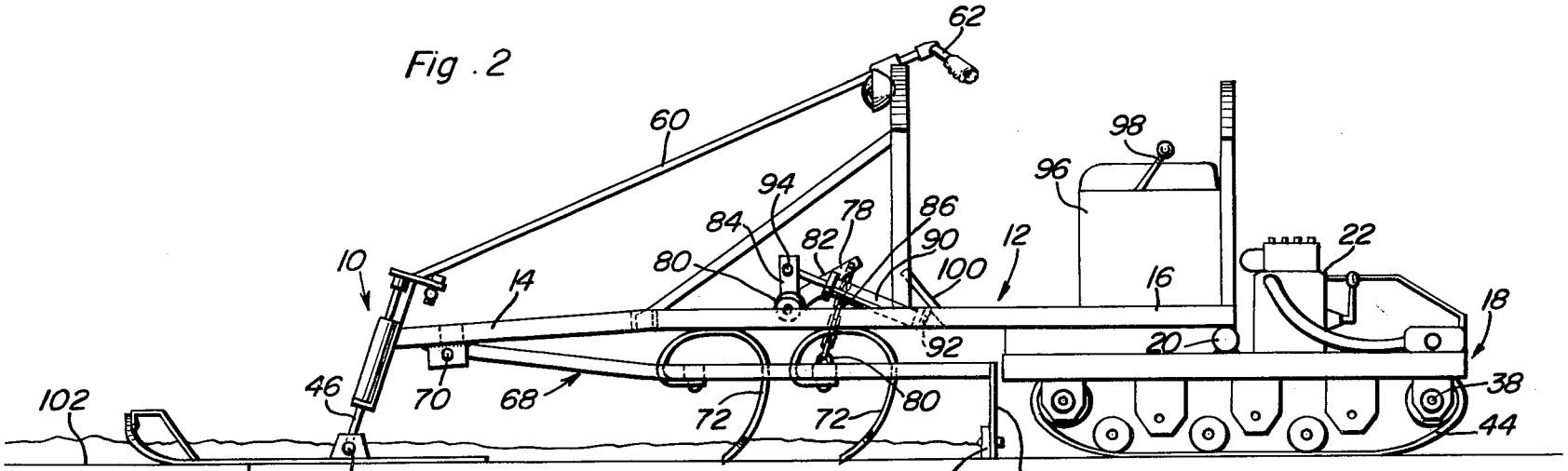
FIG. 2 is a left side elevational view of the snowmobile trail groomer.
Figure 4:
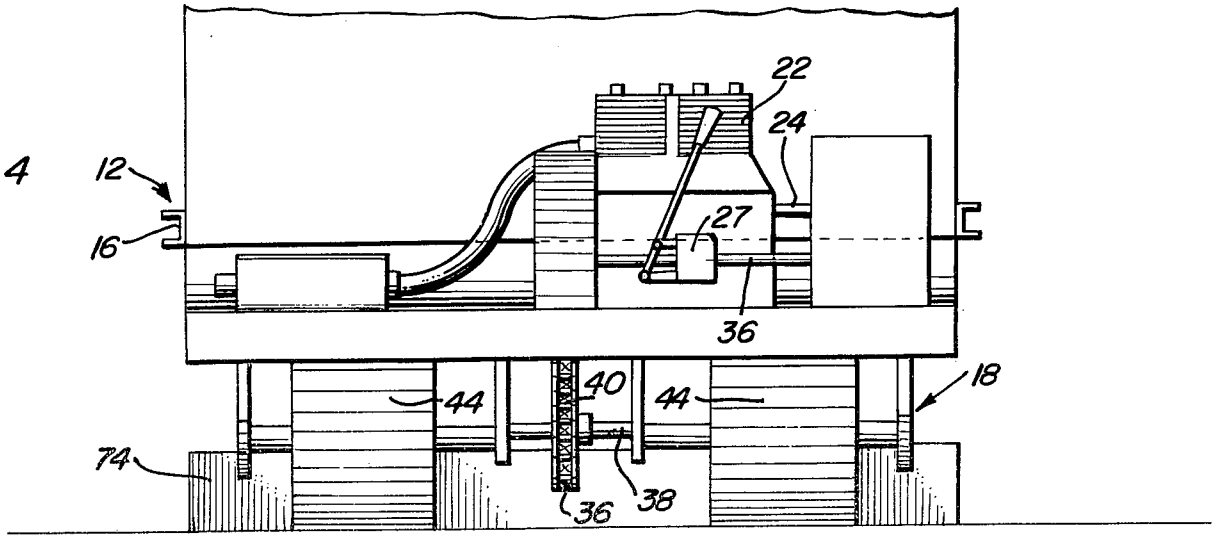
FIG. 4 is a fragmentary, enlarged, rear elevational view of the snowmobile trail groomer.

Referring now more specifically to the drawings, the numeral 10 generally designates the snowmobile trail groomer of the instant invention. The trail groomer 10 includes an elongated longitudinally extending horizontal frame referred to in general by the reference numeral 12 including front and rear end portions 14 and 16. An elongated longitudinally extending dual track endless drive assembly referred to in general by the reference numeral 18 is provided and is oscillatably supported centrally intermediate its opposite ends from the main frame 12 as at 20 for angular displacement about a horizontal transverse axis. The drive assembly 18 includes a motor 22 supported therefrom including an output shaft 24 and a transmission input shaft 26 is journaled from a transmission case 27 in spaced relation relative to the output shaft 24. The shafts 24 and 26 include variable diameter drive and driven pulleys 28 and 30, respectively, aligned with each other and an endless drive belt 32 is trained about the drive and driven pulleys 28 and 30 for driving the latter from the former. The shaft 26 additionally includes a sprocket gear 34 mounted thereon aligned with a sprocket gear 36 carried by the rear shaft 38 of the dual track endless drive assembly 18. An endless drive chain 40 is trained about the sprocket wheels 34 and 36 and thereby enables the shaft 38 to be driven from the shaft 26. The shaft 38 has a pair of opposite end drive rollers 42 mounted thereon for rotation therewith and the dual tracks 44 of the drive assembly 18 are trained about the rollers.

The forward end of the main frame 12 includes a pair of opposite side forwardly and downwardly inclined support shafts 46 journaled therefrom and the lower ends of the shafts 46 have the longitudinal midportions of a pair of opposite side front skis 48 oscillatably supported therefrom as at 50. The upper ends of the shafts 46 are interconnected by means of a pair of steering arms 52 supported therefrom and interconnected by means of a tie rod 54. In addition, a steering box 56 is supported from the front cross member 58 of the main frame 14 and the steering box is actuated by means of a rotatable rearwardly and upwardly inclined steering shaft 60 connected thereto as its forward lower end and including a transverse handle bar assembly 62 at its upper rear end. The steering box 56 includes a steering arm 64 which is oscillatable back and forth in response to back and forth rotational oscillation of the shaft 60 and the free end of the steering arm 64 is pivotally connected to the tie rod 54 as at 66. Accordingly, the front skis 48 may be steerably controlled through oscillation of the handle bar assembly 62.

The snowmobile trail groomer 10 further includes an elongated longitudinally extending sub-frame referred to in general by the reference numeral 68 underlying the forward end portion 14 of the main frame 12. The forward end of the subframe 68 is oscillatably supported from the main frame 12 as at 70 for angular displacement about a horizontal transverse axis and the subframe 68 includes longitudinally spaced sets of transversely spaced spring tines 72 dependingly supported therefrom and a rear upstanding transverse scrapper blade 74 rearward of the tines 72. The blade 74 includes a renewable lower marginal edge portion 76 which is substantially horizontal and a bell crank 78 is oscillatably supported from the main frame 12 as at 80 and includes a pair of lever arms 82 and 84. The free end of the lever arm 82 enjoys a lost motion connection with the rear end portion of the sub-frame 68 by means of a flexible chain section 86 having one end thereof connected to the free end of the arm 82 and the other end thereof connected to the sub-frame 68 as at 88. In addition, the cylinder end of a hydraulic cylinder 90 is pivotally attached to the main frame 12 as at 92 and the extendible and retractable piston end of the hydraulic cylinder 90 is pivotally attached to the lever arm 84 as at 94. Accordingly, the hydraulic cylinder 90 may be extended to raise the rear end portion of the sub-frame 68 and retracted to allow the rear end of the sub-frame 68 to be lowered.

The motor 22 drives a hydraulic pump (not shown) from which hydraulic fluid under pressure is supplied and the rear end portion 16 of the main frame 12 includes a seat structure 96 for an operator of the groomer 10. A control lever 98 is oscillatably supported from the seat structure 96 and is operative to control the pressure of hydraulic fluid supplied to the hydraulic cylinder 90 from the hydraulic pump (not shown).

In operation, the trail groomer 10 may be forwardly driven over a snowmobile trail by means of the drive assembly 18. A throttle control 100 is provided for controlling the speed of operation of the engine 22 and the entire drive assembly 18 may oscillate about a horizontal transverse axis relative to the main frame 12 during movement of the groomer 10 over a snowmobile trail. Further, the handle bar assembly 62 may be utilized to effect steerage of the groomer 10 through dirigible movement of the front skis 48 and the hydraulic cylinder 90 may be fully extended in order to raise the rear end of the sub-frame 68 sufficiently to raise the tines 72 and the blade 74 above the surface 102 of the snowmobile trail. However, when it is desired to groom a snowmobile trail which has become wavy and rutted, the control 98 is actuated to effect retraction of the hydraulic cylinder 90 and thereby allow the rear end of the sub-frame 68 to swing downwardly relative to the main frame 12 in order to bring the tines 72 and the blade 74 into contact with the wavy and rutted surface of the snowmobile trail to be groomed. The tines 72 are of the spring-type, but are capable of cutting through hard packed and icy snow in order to break up the upper surface 102 of the trail. Then, the blade 74 acts upon the broken up upper surface of the trail in order to smooth the same.

It will, of course, be noted that the tines 72 and the blade 74 are spaced intermediate the rear support for the frame 14 comprising the drive assembly 18 and the front support for the frame 14 comprising the skis 48. Accordingly, the groomer 10 will be operative to smooth out a wavy snowmobile trail as well as a rutted snowmobile trail.

Inasmuch as the drive assembly 18 is oscillatably supported from the main frame 12, the drive assembly 18 may readily conform to irregularities in the trail and thereby afford maximum traction at all times. Still further, inasmuch as the drive assembly is of the dual track type, considerable stability is afforded the groomer 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A snowmobile trail groomer including an elongated main frame including front and rear end portions, an elongated dual track drive assembly oscillatably supported from said rear end portion of said frame for angular displacement about a first horizontal transverse axis, a front dirigible ski equipped support assembly carried by the front end portion of said frame forward of said endless track drive assembly, an elongated longitudinally extending sub-frame including front and rear portions and supported from said main frame front end portion for angular displacement about a second horizontal axis extending transversely of said main frame and the front end portion of said sub-frame, the rear end portion of said sub-frame being disposed forward of said drive assembly and including transversely spaced depending packed and icy snow cover working tines and an upstanding transverse blade member rearward of said tines and including a generally horizontal lower edge portion, and lift means operatively connected between said sub-frame and main frame for selective angular displacement of said sub-frame about said second axis to raise and lower the rear end portion of said sub-frame, and thus said tines and blade member relative to snow cover over which said trail groomer is being forwardly advanced, said endless drive track assembly including a prime mover drivingly connected to the dual tracks of said track assembly and supported from the latter for oscillation therewith relative to said main frame, said lift means including means establishing a lost motion connection between said main frame and said sub-frame, whereby the downward limit of swinging movement of the rear end portion of said sub-frame may be adjustably varied and the rear end of said sub-frame may swing upwardly independent of said lift means.

2. The combination of claim 1 wherein said front dirigible ski equipped support assembly includes a pair of laterally spaced skis supported from said support assembly for independent oscillation about horizontal axes extending transversely of the longitudinal mid-portions of said skis.

3. The combination of claim 1 wherein said tines are arranged in and spaced along front and rear transverse rows of tines.

4. The combination of claim 3 wherein the tines of one row are staggered relative to the tines of the other row.

5. The combination of claim 4 wherein said tines are constructed of spring metal.

6. The combination of claim 1 wherein said front dirigible ski equipped support assembly includes a pair of laterally spaced skis supported from said support assembly for independent oscillation about horizontal axes extending transversely of the longitudinal mid-portions of said skis.

* * * * *